US012806540B2

(12) United States Patent
Ames

(10) Patent No.: US 12,806,540 B2
(45) Date of Patent: Nov. 24, 2026

(54) KIT FOR MAKING A SLIME BAKED GOOD

(71) Applicant: Summer Ames, Williston, ND (US)

(72) Inventor: Summer Ames, Williston, ND (US)

( * ) Notice: Subject to any disclaimer, the term of this patent is extended or adjusted under 35 U.S.C. 154(b) by 445 days.

(21) Appl. No.: 18/458,909

(22) Filed: Aug. 30, 2023

(65) Prior Publication Data

US 2024/0075398 A1 Mar. 7, 2024

Related U.S. Application Data

(60) Provisional application No. 63/374,329, filed on Sep. 1, 2022.

(51) Int. Cl.
*A63H 33/30* (2006.01)
*A63H 33/00* (2006.01)

(52) U.S. Cl.
CPC ..... *A63H 33/001* (2013.01); *A63H 33/3055* (2013.01)

(58) Field of Classification Search
CPC .. A63H 33/001; A63H 33/3055; B01F 23/511
USPC ..... 446/71, 75, 385, 481, 491; 426/104; 425/DIG. 57; 434/82, 127
See application file for complete search history.

(56) References Cited

U.S. PATENT DOCUMENTS 2,540,432 A * 2/1951 Evans ..... A63H 33/32 425/DIG. 57
3,598,358 A * 8/1971 Clearwaters ..... A63H 33/001 249/117
3,808,730 A * 5/1974 Cooper ..... A63H 33/3055 446/481
3,921,801 A * 11/1975 Sway ..... B65D 81/366 206/508
4,215,843 A * 8/1980 Gay ..... A63H 33/001 249/117
4,231,181 A * 11/1980 Fabricant ..... G09B 23/283 446/337
4,634,597 A * 1/1987 Spiel ..... A23K 40/20 426/549
4,767,009 A * 8/1988 Hornecker ..... B44D 3/04 206/818
5,088,598 A * 2/1992 Iguchi ..... G09B 25/00 249/55
5,258,068 A * 11/1993 Shapero ..... C08L 5/14 106/205.2
5,306,192 A * 4/1994 Caveza ..... A63H 33/3055 446/481
5,314,373 A * 5/1994 Caveza ..... A63H 33/3055 446/481

(Continued)

*Primary Examiner* — Alexander R Niconovich
(74) *Attorney, Agent, or Firm* — Fargo Patent Law; Thomas Kading

(57) ABSTRACT

A kit sold as a single package within a kit container in which a multiple of simulated ingredients are each packaged within their own container. The kit for making a slime baked good includes a simulated ingredient egg that comprises a clay yolk and a clear glue slime white; a simulated ingredient flour that comprises cornstarch; a simulated ingredient butter that comprises clay; a simulated ingredient sugar that comprises plastic snow; and a recipe card within the kit container which provides instructions for a user to simulate the creation and "baking" of a slime baked good as a non-food with at least the contents of the kit container.

17 Claims, 5 Drawing Sheets

(56) References Cited

U.S. PATENT DOCUMENTS 5,346,423 A * 9/1994 Caveza ..... A63H 33/3055 426/104
5,387,149 A * 2/1995 Caveza ..... A21C 9/06 99/450.6
5,401,525 A * 3/1995 Vassiliou ..... A23L 15/35 426/573
5,447,584 A * 9/1995 Shakespeare ..... C08L 3/02 446/87
5,512,003 A * 4/1996 Parker ..... A63H 13/16 124/79
5,562,927 A * 10/1996 Masuda ..... A63H 33/001 434/81
5,727,979 A * 3/1998 Spector ..... A63H 9/00 446/87
5,804,235 A * 9/1998 Altschul ..... A23L 7/126 426/94
5,851,415 A * 12/1998 Thomas ..... A23G 9/221 249/117
5,858,262 A * 1/1999 Lebensfeld ..... A63H 9/00 249/176
5,934,969 A * 8/1999 Rehkemper ..... A63H 33/001 446/373
5,954,561 A * 9/1999 Cannone ..... A63H 33/3055 446/481
6,348,534 B1 * 2/2002 Bianco ..... C08K 5/103 524/378
7,044,466 B2 * 5/2006 Laibson ..... A63F 3/0478 273/278
7,371,144 B1 * 5/2008 Begien ..... A63H 33/32 434/84
7,959,442 B2 * 6/2011 Nichols ..... G09B 1/32 434/127
8,152,528 B2 * 4/2012 Alm ..... G09B 19/00 99/324
8,333,917 B1 * 12/2012 Schwendimann ..... B29C 67/00 264/308
8,460,005 B1 * 6/2013 Pompey ..... G09B 19/00 434/295
8,465,337 B2 * 6/2013 Eisenhut ..... A63H 33/001 446/87
8,633,269 B2 * 1/2014 Cordova ..... C08K 5/11 524/451
9,728,098 B2 * 8/2017 Sabourian-Tarwe ..... G16H 40/63
10,022,642 B1 * 7/2018 Adams ..... G09B 19/20
10,654,016 B2 * 5/2020 Alber ..... B01F 33/5014
11,420,133 B2 * 8/2022 Loik ..... A63H 33/32
11,420,169 B2 * 8/2022 Alber ..... B01F 35/32021
11,850,533 B1 * 12/2023 Consorti ..... A63H 33/001
2004/0198138 A1 * 10/2004 Vasic ..... A63H 33/00 446/71
2006/0017198 A1 * 1/2006 Koehl ..... B29C 33/02 425/DIG. 57
2006/0282329 A1 * 12/2006 Lund ..... G06Q 30/02 705/15
2015/0056334 A1 * 2/2015 Tutin ..... A21D 10/025 426/87
2018/0169536 A1 * 6/2018 Wells ..... A41D 13/04
2019/0370873 A1 * 12/2019 Ing-Gilbert ..... G07F 13/06
2021/0170640 A1 * 6/2021 Tsai ..... A63H 33/001
2021/0252905 A1 * 8/2021 Wright ..... B44C 5/00
2024/0252941 A1 * 8/2024 Hill ..... A63H 9/00
2025/0073610 A1 * 3/2025 Consorti ..... A63H 33/001
2026/0115621 A1 * 4/2026 Consorti ..... A63H 33/001

* cited by examiner

KIT FOR MAKING A SLIME BAKED GOOD

CROSS REFERENCE TO RELATED APPLICATION[S]

The present disclosure claims priority to U.S. Provisional Patent Disclosure Ser. No. 63/374,329 filed Sep. 1, 2022.

BACKGROUND

The present disclosure relates to a kit to "bake" a simulated baked goods from "slime".

Squishy gelatinous mixtures known as "slime" is a unique sensory play substance typically of polyvinyl alcohol (PVA), a solution like white glue, and borate ions, commonly found in borax. When the white glue reacts with the borate ions, a thick, sticky "non-Newtonian fluid," is formed that is neither a liquid nor a solid.

The "slime" is often artfully crafted to create realistic-looking simulated baked goods which can thereafter be squished, pulled, poked, stretched, and crushed, whimsically dissolving the illusion.

SUMMARY

A kit for making a slime baked good according to one disclosed non-limiting embodiment of the present disclosure includes a kit container; a first simulated ingredient within a container contained within the kit container; a recipe card within the kit container; and a jar of slime within the kit container.

A further embodiment of any of the foregoing embodiments of the present disclosure includes that the first simulated ingredient represents an egg comprised of a clear slime egg white, and a clay yolk, the clay yolk dried for 5 hours to create a barrier around the yolk so that the clay and slime are not mixed.

A further embodiment of any of the foregoing embodiments of the present disclosure includes a second simulated ingredient that represents flour, the second simulated ingredient within the kit container.

A further embodiment of any of the foregoing embodiments of the present disclosure includes a third simulated ingredient that represents butter, the third simulated ingredient within the kit container.

A further embodiment of any of the foregoing embodiments of the present disclosure includes a fourth simulated ingredient that represents sugar, the fourth simulated ingredient within the kit container.

A further embodiment of any of the foregoing embodiments of the present disclosure includes that the first simulated ingredient represents butter comprised of clay.

A further embodiment of any of the foregoing embodiments of the present disclosure includes that the first simulated ingredient represents flour comprised of cornstarch.

A further embodiment of any of the foregoing embodiments of the present disclosure includes that the first simulated ingredient represents sugar comprised of plastic snow.

A further embodiment of any of the foregoing embodiments of the present disclosure includes a scent representative of the respective simulated ingredient.

A kit for making a slime baked good according to one disclosed non-limiting embodiment of the present disclosure includes a simulated ingredient egg that comprises a clay yolk and a clear glue slime white; a simulated ingredient flour that comprises cornstarch; a simulated ingredient butter that comprises clay; and a simulated ingredient sugar that comprises plastic snow.

A further embodiment of any of the foregoing embodiments of the present disclosure includes that one or more of the simulated ingredients further comprise a scent representative of the respective simulated ingredient.

A further embodiment of any of the foregoing embodiments of the present disclosure includes that the simulated ingredients are contained within a box and each individual simulated ingredient is contained within its own container.

A further embodiment of any of the foregoing embodiments of the present disclosure includes a 6 ounce jar of slime within the box.

A further embodiment of any of the foregoing embodiments of the present disclosure includes a recipe card within the box.

The foregoing features and elements may be combined in various combinations without exclusivity, unless expressly indicated otherwise. These features and elements as well as the operation thereof will become more apparent in light of the following description and the accompanying drawings. It should be appreciated that however the following description and drawings are intended to be exemplary in nature and non-limiting.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
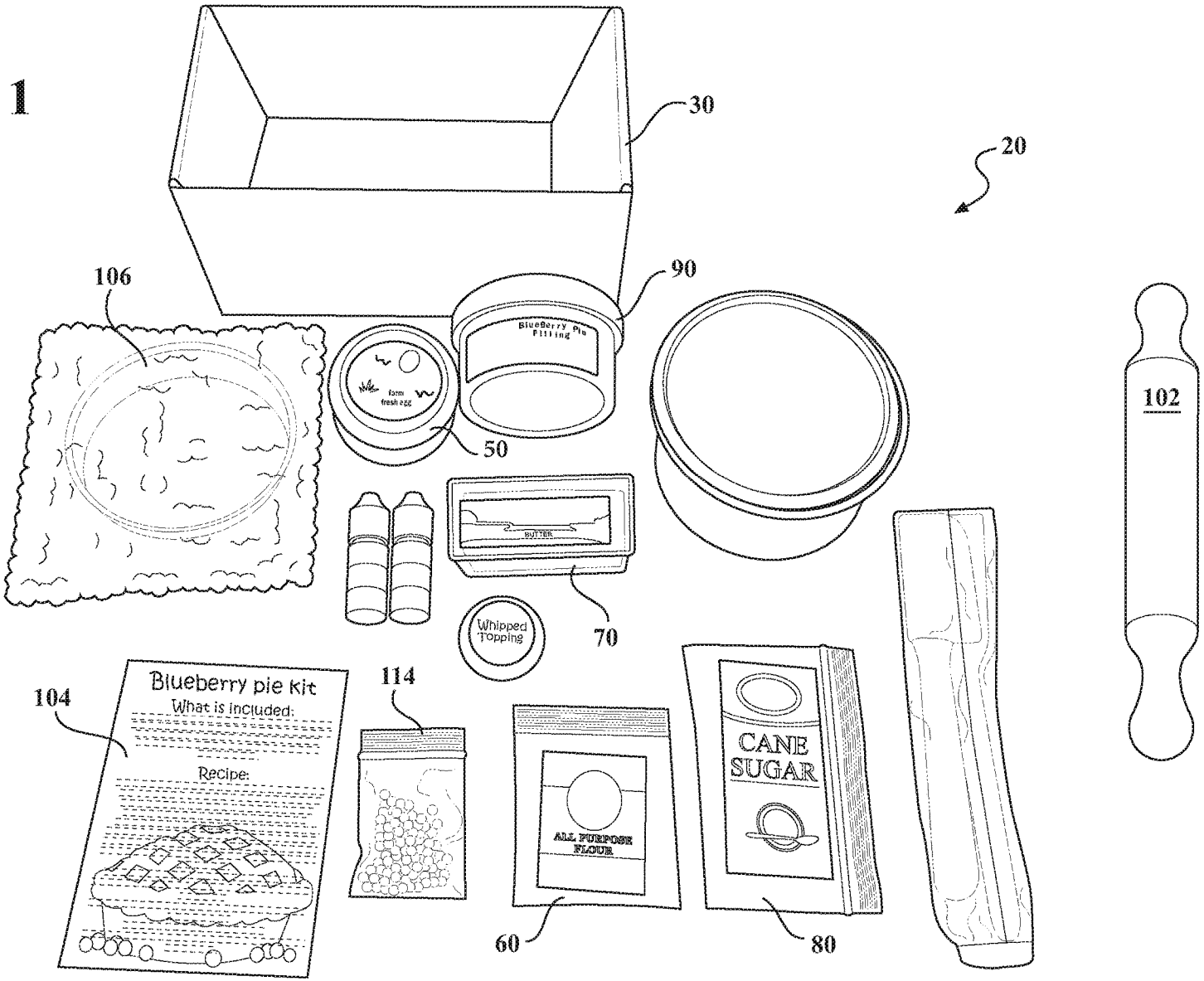
FIG. 1 is a perspective view of a kit for making a slime baked good according to one disclosed non-limiting embodiment.

FIG. 1 schematically illustrates a kit 20 for making a slime baked good that uses simulated ingredients to "bake" a baked good (out of slime) to artfully craft realistic-looking food from a squishy gelatinous mixture known as "slime" that can then be squished, pulled, poked, stretched, and crushed, whimsically dissolving the illusion.

The kit 20 for the slime baked good includes the appropriate simulated ingredients which allow a user to simulate the creation and "baking" of a slime baked good as a non-food. That is, the simulated ingredients allow a user to create a simulated non-edible (but safe) baked good. All simulated ingredients in the kit 20 are safe and non-toxic and are adapted to be specific slime making ingredients, e.g., cornstarch instead of flour because some people may have skin sensitivities to gluten, etc. The simulated ingredients may alternatively or additionally include, clay (e.g., soft polymer clay, air dry clay, etc.); plastic; cornstarch; slime; water; colorant (e.g., food dye, etc.); food grade oil (e.g., vegetable oil, etc.); resin; glue; rubber (e.g., silicone, natural rubber, etc.); other food safe components, or any combination thereof; etc.

The kit 20 may be sold as a single package within a kit container 30 such as a box, in which a multiple of simulated ingredients are each packaged within their own container. The components of the slime baking kit may include, for example, a simulated ingredient 50 that represents an egg, a simulated ingredient 60 that represents flour, a simulated ingredient 70 that represents butter, a simulated ingredient 80 that represents sugar, and a container of slime 90. One or more of the simulated ingredients may be scented. Other simulated ingredients may be alternatively or additionally included depending on the type of baked good which is to be simulated.

The kit 20 may also include one or more baking tools 100, such as, for example a mini rolling pin 102, a recipe card 104, a pie tin 106, a mini spatula 108 (FIG. 2), a donut mold 110 (FIG. 3), charms 114 (FIG. 1), sprinkles 112 (FIG. 3), etc.

Each kit 20 provides a self-contained kit for "baking" a slime baked good in which each simulated ingredient is enclosed within its own container. That is, the kit container 30 may be a box that contains each simulated ingredient enclosed within its own container, e.g., slime within a shatterproof secure screw top jar, simulated ingredient butter within a rectilinear plastic package, simulated ingredient sugar within a bag, etc.

In one specific example, a kit 20 for "baking" the slime baked good such as a pie contains the following simulated ingredients:

Simulated ingredient Butter—clay.
Simulated ingredient Sugar—plastic snow.
Simulated ingredient Flour—cornstarch.
Simulated ingredient Egg—clear slime for the egg white, clay for the yolk.
Simulated ingredient Vanilla—water and food dye.
Simulated ingredient Whipped topping—clay.
Simulated ingredient Oil—vegetable oil.
Simulated ingredient charms—resin charms that resemble the pie flavor fruit.
A 6 oz. container of slime—clear glue slime scented and colored to simulate the type of pie e.g., cherry, blueberry, strawberry etc.
Pie tin—aluminum mini pie tin 106.
Rolling pin—mini wooden rolling pin 102.
Spatula—plastic handle and silicone spatula 108.
Recipe Card 104—a card that recites the steps to put together the slime baked good.

To assemble the pie, the simulated butter, sugar, flour, egg and vanilla are combined using the spatulas to create a pie crust dough. The pie crust dough may be refrigerated for a time period such as 5-10 minutes. Then, the rolling pin is oiled and the pie crust dough is rolled out with the rolling pin. A rolling pin and surface on which the pie crust dough is rolled may be coated with a portion of the simulated flour. The pie crust dough is put in the pie tin. The 6 oz slime may then be added to the pie to simulate the pie filling. Next, the pie may be topped with simulated whipped topping and charms.

Figure 2:
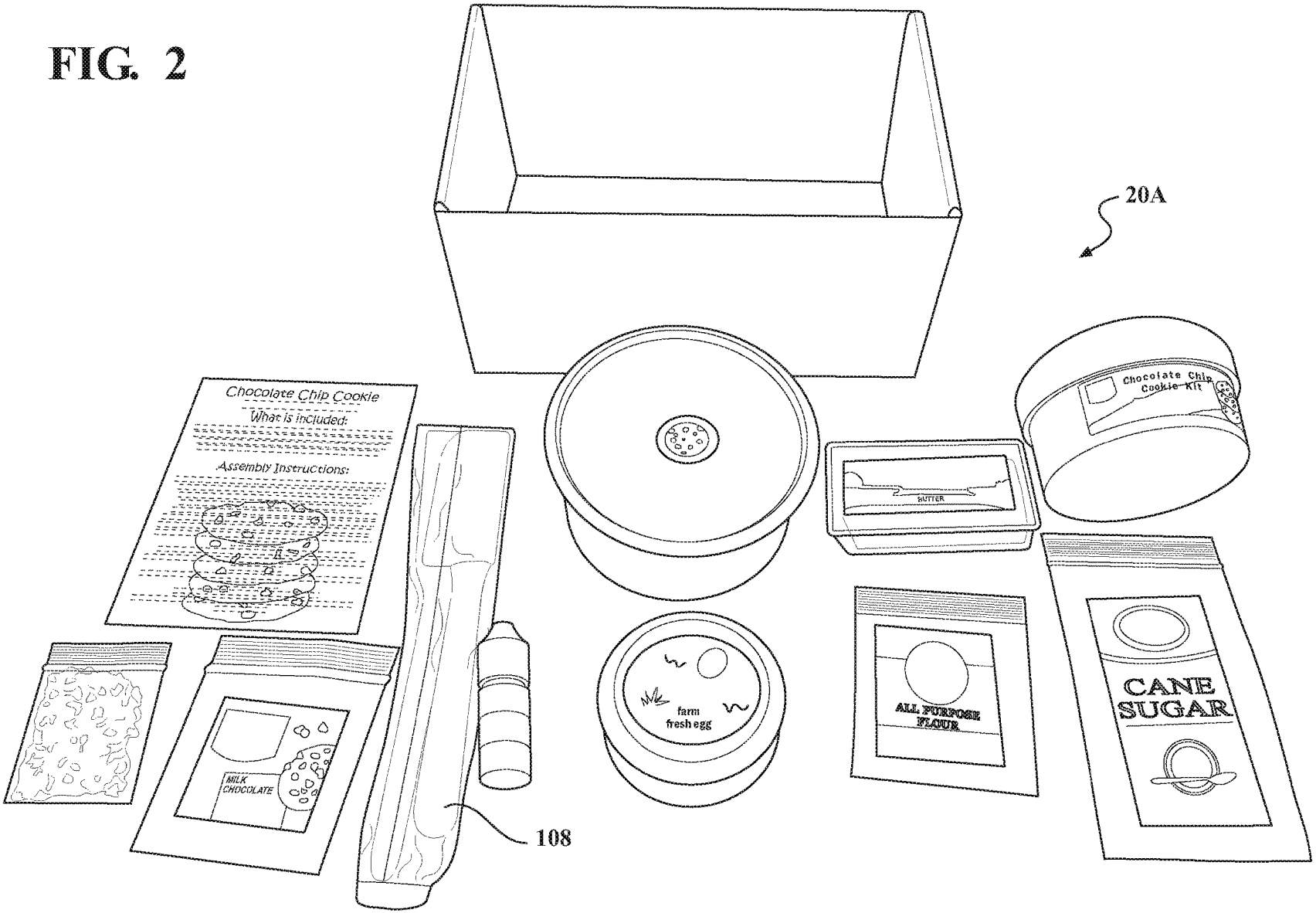
FIG. 2 is a perspective view of a kit for making a slime baked good according to another disclosed non-limiting embodiment.

With reference to FIG. 2, in another specific example, a kit 20A for "baking" a slime baked good such as a Chocolate Chip Cookie contains the following simulated ingredients:

Simulated ingredient Butter—clay.
Simulated ingredient Sugar—plastic snow.
Simulated ingredient Flour—cornstarch.
Simulated ingredient Egg—clay and clear glue slime.
Simulated ingredient Vanilla—water and food dye.
Simulated ingredient Chocolate chips—resin charms.
6 oz Jar of Slime—white glue slime scented to simulate chocolate chip cookie.
Spatula—plastic handle and silicone spatula.
Recipe Card—card that recites the steps to put together the slime baked good.

To assemble the cookie, the simulated butter, sugar, flour, egg, vanilla, and chocolate chips are combined using the spatula to create a dough. The dough may be refrigerated for a time period such as 5-10 minutes. Then, the dough is hand molded into cookie shapes. Alternatively, the simulated chocolate chips may be added after molding the dough. The cookies may be placed on top of the slime. The cookies may then be mixed into the 6 oz jar of slime.

Figure 3:
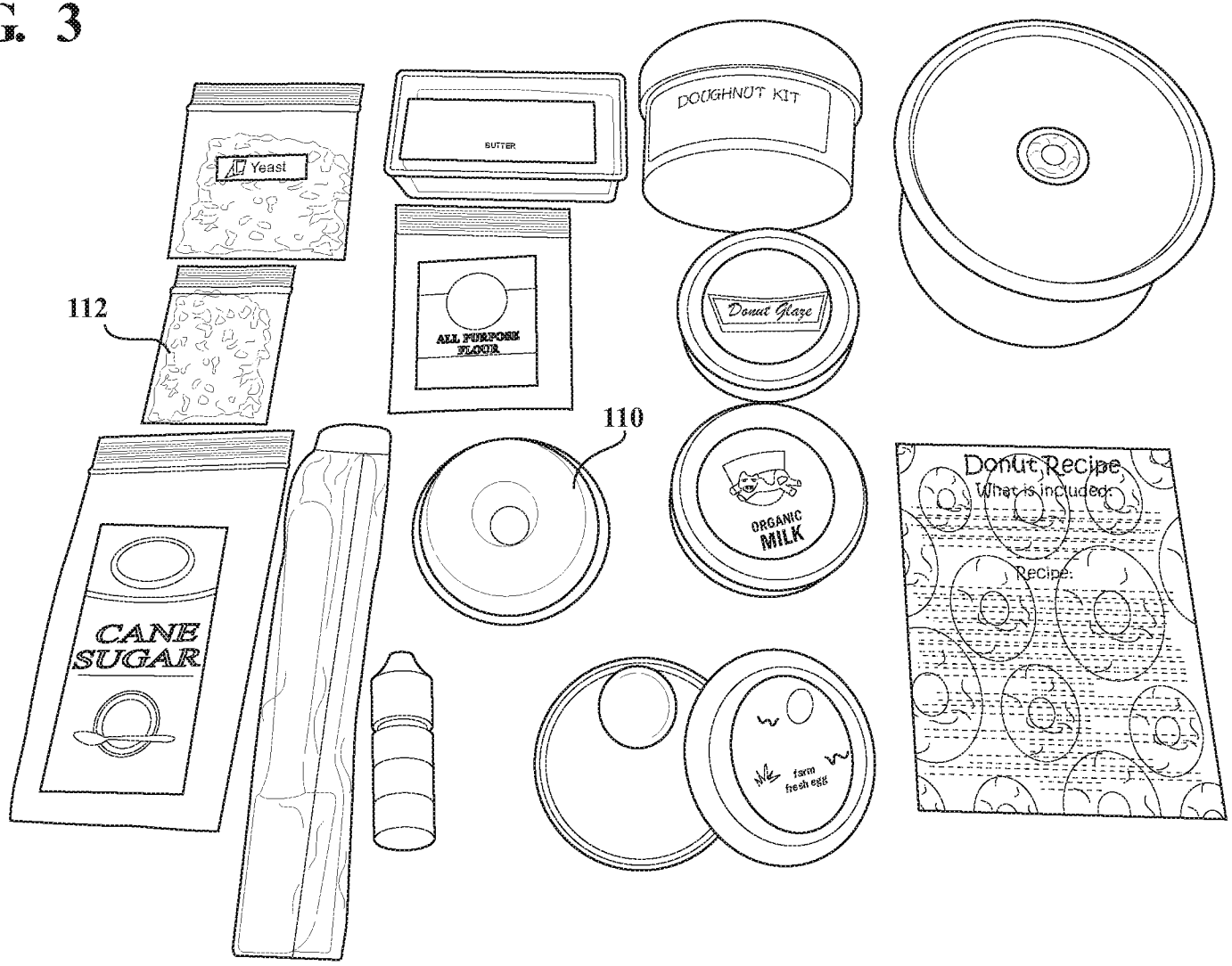
FIG. 3 is a perspective view of a kit for making a slime baked good according to another disclosed non-limiting embodiment.

With reference to FIG. 3, in another specific example, a kit 20B for "baking" a slime baked good such as a donut contains the following simulated ingredients:

Simulated ingredient Butter—clay.
Simulated ingredient Sugar—plastic snow.
Simulated ingredient Flour—cornstarch.
Egg—clay and clear glue slime.
Simulated ingredient Oil—vegetable oil.
Simulated ingredient Yeast—rubber polymer crumbs.
Simulated ingredient Milk—white glue slime.
Simulated ingredient Sprinkles—clay.
Simulated ingredient Donut Glaze—clear glue slime.
6 oz jar of clear or white glue slime.
Spatula—plastic handle and silicone spatula.
Donut mold—silicone mold.
Recipe Card—card that recites the steps to create the slime baked good.

To assemble the donut, the simulated butter, sugar, flour, egg, yeast, and milk are combined using the spatula to create a dough. Then, the donut mold is oiled and the dough is molded into the mold. The dough may be refrigerated for a time period such as 15 minutes. The top of the donut may then be decorated with the glaze and the sprinkles. The donuts may be placed on top of the slime. The donuts may then be mixed into the 6 oz slime.

Figure 4:
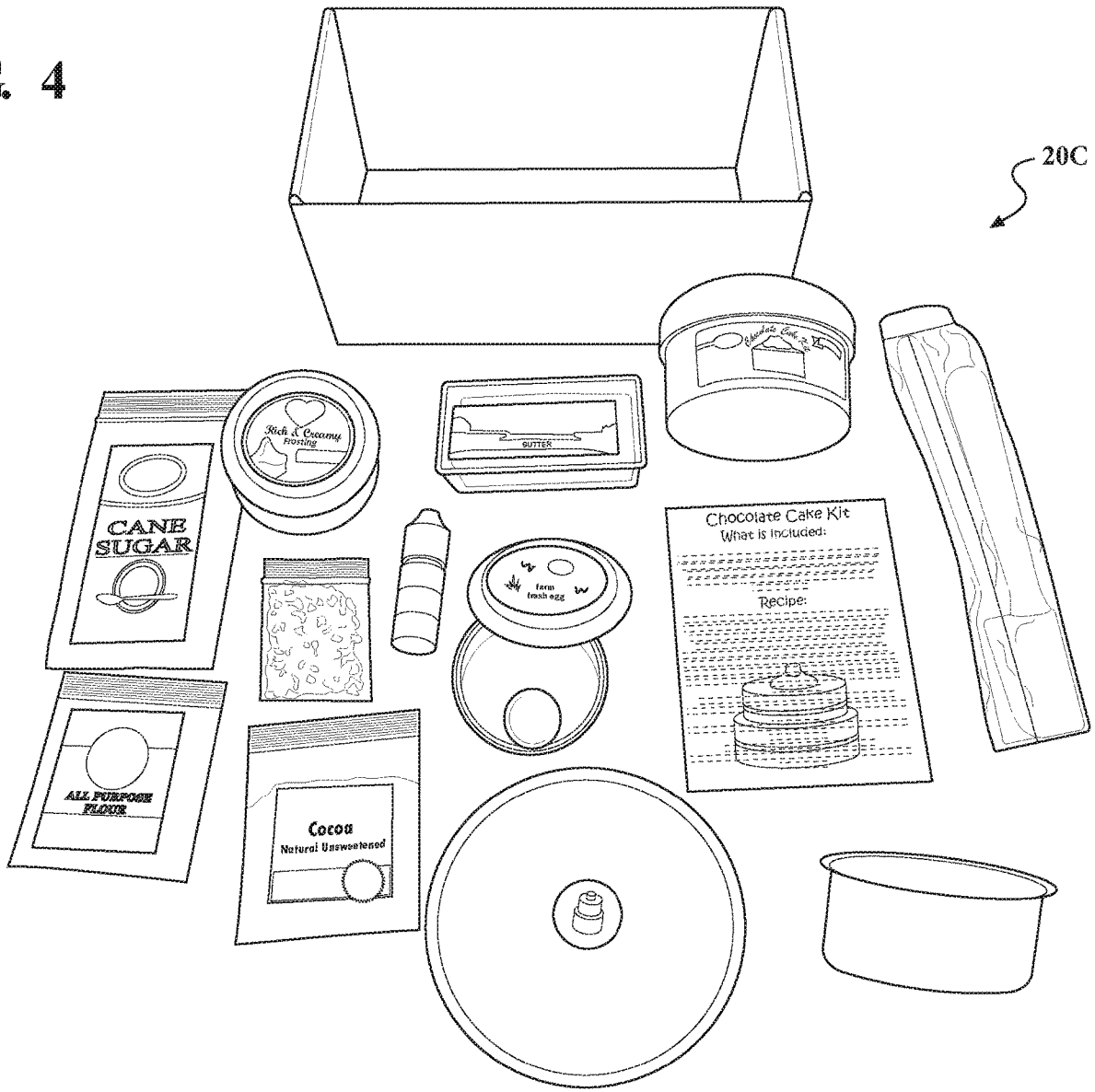
FIG. 4 is a perspective view of a kit for making a slime baked good according to another disclosed non-limiting embodiment.

Each kit may vary to make various types and/or flavors of, for example, various pie kits 20 (apple, strawberry, blueberry, key lime, lemon, banana (FIG. 1)), cookie kits 20A (chocolate chip, strawberry sugar (FIG. 2)), donut kits 20B (chocolate, jelly, powdered, glazed (FIG. 3)), cake kits 20C (chocolate, strawberry, carrot, pink champagne, sponge (FIG. 4)), etc. The kits allow a user to take the non-edible slime making ingredients to create a realistic baked good (out of slime). All the individual components of the kit 20 look like the real ingredient and are provided in their own container.

Slime may be a tricky substance that does not hold its shape well. Applicant has determined that to make cookies, pie crusts, and donuts hold their shape the materials used and ratios are important.

Figure 5:
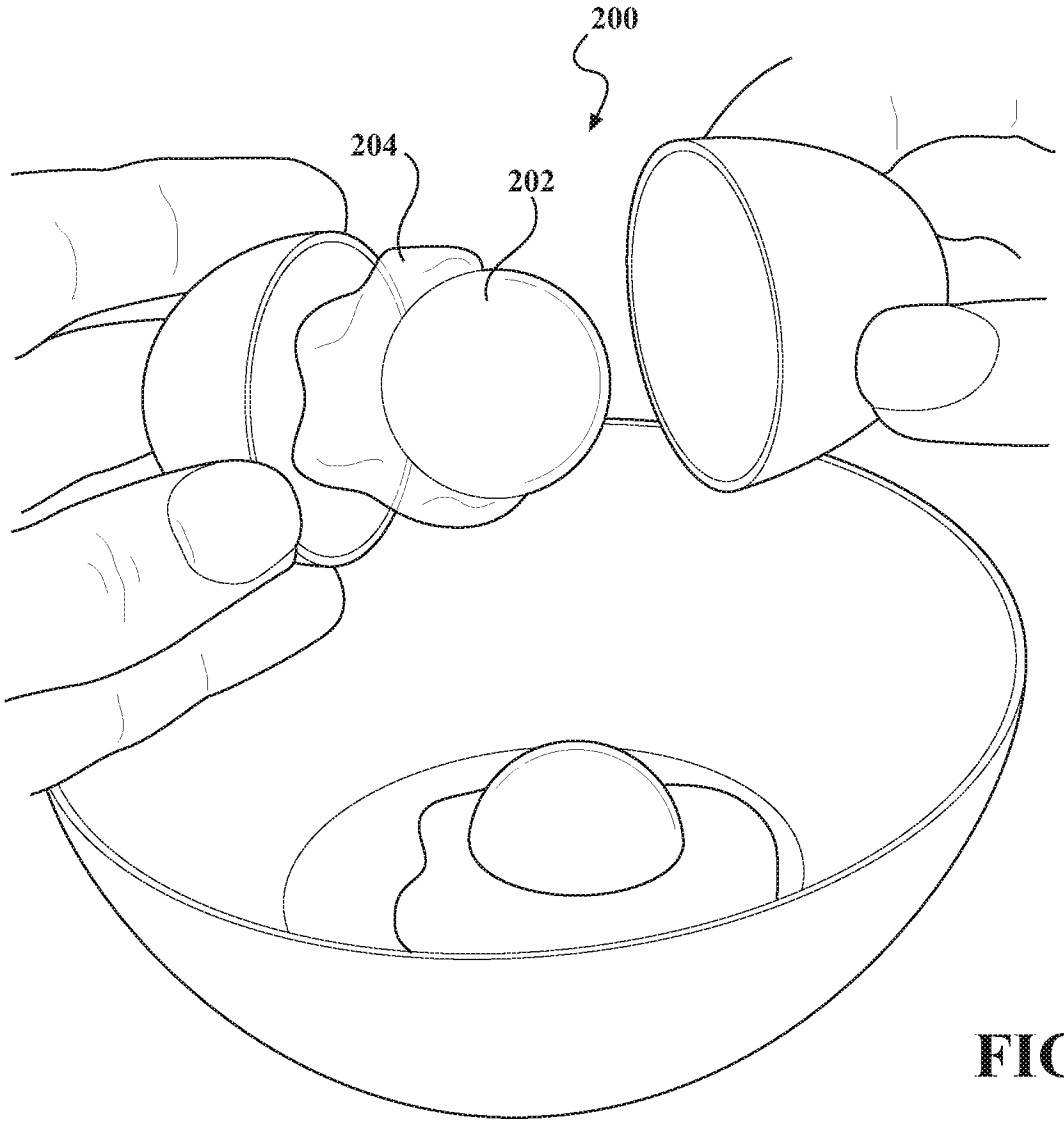
FIG. 5 is a perspective view of a simulated egg ingredient.

Applicant has determined that for a simulated raw egg 200 (FIG. 5) in order to pack the yolk 202 (clay) with the egg white 204 (clear glue slime), the clay yolk is dried for about hours to create a barrier around the yolk so that the clay and slime would not mix in transit. This prevents the simulated egg from looking "scrambled" when received by the user.

Applicant has determined that the texture of the pie crusts may be controlled by the amount of "flour" (cornstarch) to create a firmer "crust". The quantity of "butter" (clay) is controlled to create a firmer "pie crust". The quantity of "egg white" (clear slime) is controlled to create a firmer "crust".

Specialized simulated ingredient processes for particular sensitive ingredients may include:

Egg packaging:

1) rolling out clay into a small yolk sized ball;

2) drying out the ball of clay for about 5 hours; and 3) placing the yolk and clear glue slime into a jar.

Butter packaging:

1) use a mold to make the butter shape out of clay;

2) seal the clay into a plastic shrink wrap; and 3) placing the sealed butter into a plastic container.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. A kit for making a slime baked good, comprising:

a kit container;

a first simulated baked good ingredient within a container within the kit container; wherein the first simulated baked good ingredient represents an egg comprised of a clear slime egg white and a clay yolk, the clay yolk dried for 5 hours to create a barrier around the clay yolk so that the clay yolk and the clear slime egg white are not mixed;

a recipe card within the kit container which delineates instructions for a user to simulate creation of a slime baked good as a non-food with at least that contained within the kit container; and a jar of slime within the kit container.

2. The kit as recited in claim 1, further comprising a second simulated baked good ingredient that represents flour, the second simulated ingredient within the kit container.

3. The kit as recited in claim 2, further comprising a third simulated baked good ingredient that represents butter, the third simulated ingredient within the kit container.

4. The kit as recited in claim 3, further comprising a fourth simulated baked good ingredient that represents sugar, the fourth simulated ingredient within the kit container.

5. The kit as recited in claim 1, wherein the first simulated baked good ingredient represents butter comprised of clay.

6. The kit as recited in claim 1, wherein the first simulated baked good ingredient represents flour comprised of cornstarch.

7. The kit as recited in claim 1, wherein the first simulated baked good ingredient represents sugar comprised of plastic snow.

8. The kit as recited in claim 1, further comprising a scent representative of the respective simulated baked good ingredient.

9. A kit for making a slime baked good, comprising:

a simulated baked good ingredient egg that comprises a clay yolk and a clear glue slime white;

a simulated baked good ingredient flour that comprises cornstarch;

a simulated baked good ingredient butter that comprises clay; and a simulated baked good ingredient sugar that comprises plastic snow.

10. The kit as recited in claim 9, wherein one or more of the simulated baked good ingredients further comprise a scent representative of the respective simulated ingredient.

11. The kit as recited in claim 9, wherein the simulated baked good ingredients are contained within a box and each individual simulated ingredient is contained within its own container.

12. The kit as recited in claim 11, further comprising a 6 ounce jar of slime within the box.

13. The kit as recited in claim 12, further comprising a recipe card within the box, the recipe card delineates instructions for a user to simulate "baking" of a slime baked good as a non-food with at least that contained within the kit container.

14. The kit as recited in claim 11, further comprising a recipe card within the kit container which delineates instructions for a user to simulate "baking" of a slime baked good as a non-food with at least that contained within the kit container.

15. A kit for making a slime baked good, comprising:

a kit container;

a simulated baked good ingredient egg that comprises a clay yolk and a clear glue slime white within the kit container;

a simulated baked good ingredient flour that comprises cornstarch within the kit container;

a simulated baked good ingredient butter that comprises clay within the kit container;

a simulated baked good ingredient sugar that comprises plastic snow within the kit container; and a recipe card within the kit container which provides instructions for a user to simulate "baking" of a slime baked good as a non-food with at least that contained within the kit container.

16. The kit as recited in claim 15, wherein the simulated baked good ingredient egg comprises:

1) rolling out clay into a yolk sized ball;

2) drying out the ball of clay for about 5 hours; and 3) placing the clay yolk and clear glue slime into a jar for packing into the kit container.

17. The kit as recited in claim 15, wherein the simulated baked good ingredient butter comprises:

1) using a mold to make a butter shape out of clay;

2) sealing the clay into a plastic shrink wrap; and 3) placing the sealed butter into a plastic container for packing into the kit container.

* * * * *